United States Patent [19]

Bernhard

[11] Patent Number: 4,727,660

[45] Date of Patent: Mar. 1, 1988

[54] SHOE FOR REHABILITATION PURPOSES

[75] Inventor: Constantin Bernhard, Munich, Fed. Rep. of Germany

[73] Assignee: Puma AG Rudolf Dassler Sport, Herzogenaurach, Fed. Rep. of Germany

[21] Appl. No.: 872,734

[22] Filed: Jun. 10, 1986

[30] Foreign Application Priority Data

Jun. 10, 1985 [DE] Fed. Rep. of Germany ..... 3520786

[51] Int. Cl.[4] ..... A43B 7/14; A61F 5/04

[52] U.S. Cl. ..... 36/88; 36/110; 36/32 R; 128/83.5

[58] Field of Search ..... 36/88, 103, 110, 30 R, 36/32 R, 11.5; 128/83.5

[56] References Cited

U.S. PATENT DOCUMENTS

| | | | |
|---|---|---|---|
| 2,885,797 | 5/1959 | Chrencik | 36/92 |
| 3,584,402 | 6/1971 | Silverman | 36/11.5 |
| 3,661,151 | 5/1972 | Schoenbrun et al. | 128/83.5 |
| 3,802,424 | 4/1974 | Newell | 128/83.5 |
| 3,905,135 | 9/1975 | Debusk | 36/110 |
| 4,085,527 | 4/1978 | Riggs | 36/32 R |
| 4,128,950 | 12/1978 | Bowerman et al. | 36/30 R |
| 4,134,220 | 1/1979 | Dassler | 36/30 R |
| 4,364,188 | 12/1982 | Turner et al. | 36/30 R |
| 4,425,721 | 1/1984 | Spronken | 36/110 |
| 4,446,856 | 5/1984 | Jordan | 128/83.5 |
| 4,578,882 | 4/1986 | Talarico, II | 36/30 R |
| 4,602,676 | 7/1986 | Johnson | 128/83.5 |
| 4,614,046 | 9/1986 | Dassler | 36/30 R |

FOREIGN PATENT DOCUMENTS

| | | | |
|---|---|---|---|
| 1217905 | 5/1960 | France | 36/30 R |

*Primary Examiner*—Steven N. Meyers

*Attorney, Agent, or Firm*—Sixbey, Friedman & Leedom

[57] ABSTRACT

A shoe for rehabilitation purposes, particularly for wear in connection with foot injuries and/or after foot surgery is designed such that patients with foot injuries or after foot surgery can remove rigid supports like plaster casts, orthotics, or the like, in a short time, enabling them to walk again as soon as possible without fear of additional damage or subsequent injuries. To this end, a shoe is provided with an outsole 6 with a front part 8 that extends from the shoe tip 7, which it upwardly embraces, to approximately the toe base joint. The front part 8 consists of an unprofiled material with a low coefficient of friction and is followed by a profiled outsole part 10 comprised of an abrasion-resistant flexible material. The separation line 11 between the two profiled sections 8, 10 extends diagonally rearward from the medial side of the shoe in front of the big toe ball area to the lateral side of the shoe in front of the small toe ball area. The wedge-like midsole 5 consists of a continuous midsole 3 and a wedge 4 which extends from the heel to the narrowing midfoot area. The midsole 3 has a higher cushioning coefficient (lower hardness) than the wedge 4. Finally, the wedge 4 is longer on the medial side of the foot than on the lateral side thereof.

24 Claims, 4 Drawing Figures

SHOE FOR REHABILITATION PURPOSES

The present invention relates to a shoe for rehabilitation purposes, particularly for rehabilitation of a foot that has been injured and/or undergone surgery.

German Auslegeschrift No. 28 08 968 discloses an orthotic device, open at the forefoot, for post-operative treatment of fractures or for use after foot surgery. This orthotic device has a one-piece heel and foot portion as well as an integrated sole plate. The above reference does not discuss the properties of the sole, except for information that it should be flat in the toe area. This known orthotic device is a means for immobilizing fractures or surgically treated joints, and due to its very nature, must be of rigid construction.

Contrary to the above, the primary objective of the present invention is to provide a shoe for rehabilitation purposes of the kind discussed, but designed such that patients with foot injuries or patients who have undergone foot surgery can remove rigid supports, like plaster casts, orthotics, and the like, in a very short time and can resume walking at an early date without incurring additional or subsequent injuries; for instance by an incorrect gait posture caused by so-called "protective supports" particularly in the minikus, knee, or disk area. It is of vital importance that muscular atrophy of the foot portions affected, and stiffening (ankylosis) of joints and tendons be kept to a minimum or be entirely avoided, enabling the patient to again function normally in a short time and permitting an athlete to resume his training as early as possible.

This objective is achieved in accordance with the novel features provided in the present invention.

Firstly, a slidable sole tip feature of the present invention prevents the patient's foot from being adversely stressed, when he assumes a protective posture in which the foot tip is usually hanging downwardly and inwardly while walking, if weight is placed thereon by an abrupt braking motion, even if the front shoe tip contacts the ground. In this posture, making ground contact originates from the foot tip, and not from the heel. However, after striking and sliding of the foot tip, it is desirable that good ground contact is obtained once again, which is achieved, here, by the outer sole having a non-skid construction in the ball area.

Another feature in accordance with a preferred embodiment of the inventive design is that the sole is designed as a dual layer wedge sole, and due to a harder design of the wedge, which extends from the heel maximally up to the ball portion, a soft bending zone is created which promotes favorable pronation and a good cushioning subsequent to the foot making ground contact. Moreover, this bending zone, at least approximates the slope of the ball area, so that the wedge is longer on the medial (inner) side than on the lateral (outer) side of the shoe.

Such a shoe design is especially useful for foot injuries and/or surgical procedures of the capsule, capsular ligament and ankle area, or for ruptures of the ligaments.

It is known from German Offenlegungsschrift No. 26 35 474 and its corresponding U.S. Pat. No. 4,134,220 to coat the tip of an outsole with suede leather in order to reduce wear, and simultaneously to enhance skid properties. In accordance with that disclosure, however, the lateral ball area is also covered with suede leather, and means are provided there to render the outsole sufficiently non-skid by way of ground contact of the outsole material in the medial ball area. The remaining characteristics of the outsole are not discussed except that the outsole should be a layered sole made of resilient, soft synthetic material, for example, polyurethane foam.

Moreover, it is known from German Gebrauchsmuster No. 84 23 344 (which corresponds to U.S. Pat. No. 4,614,046) to stiffen the soles of athletic shoes in the rear foot area by using harder inserts. These stiffening inserts, however, are provided under a soft sole segment, i.e., either only on the medial side or as C-shaped parts with a C-opening at the lateral side, and they do not extend to the beginning of the ball area. An optimum flexibility of the sole in the ball area is not obtained therewith.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
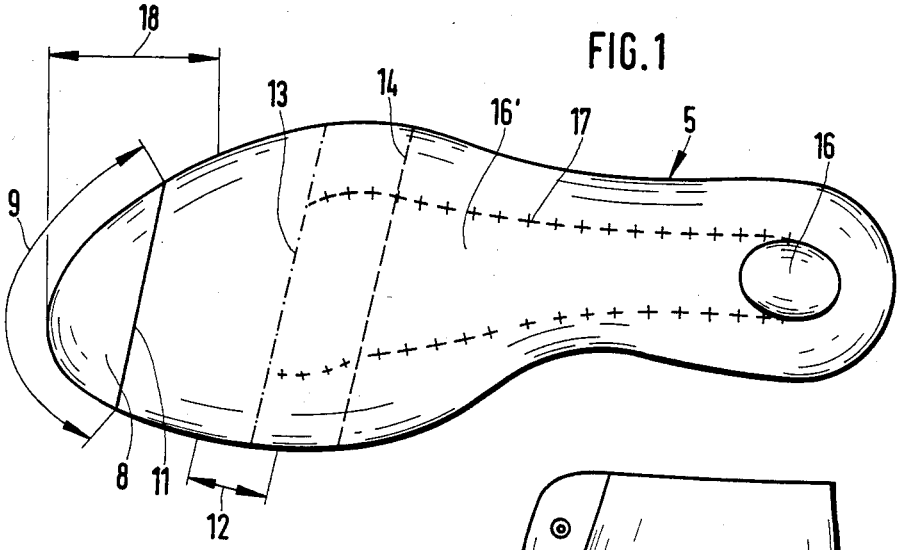
FIG. 1 is a bottom view of a shoe sole of a shoe for rehabilitation purposes, in accordance with the invention.
Figure 2:
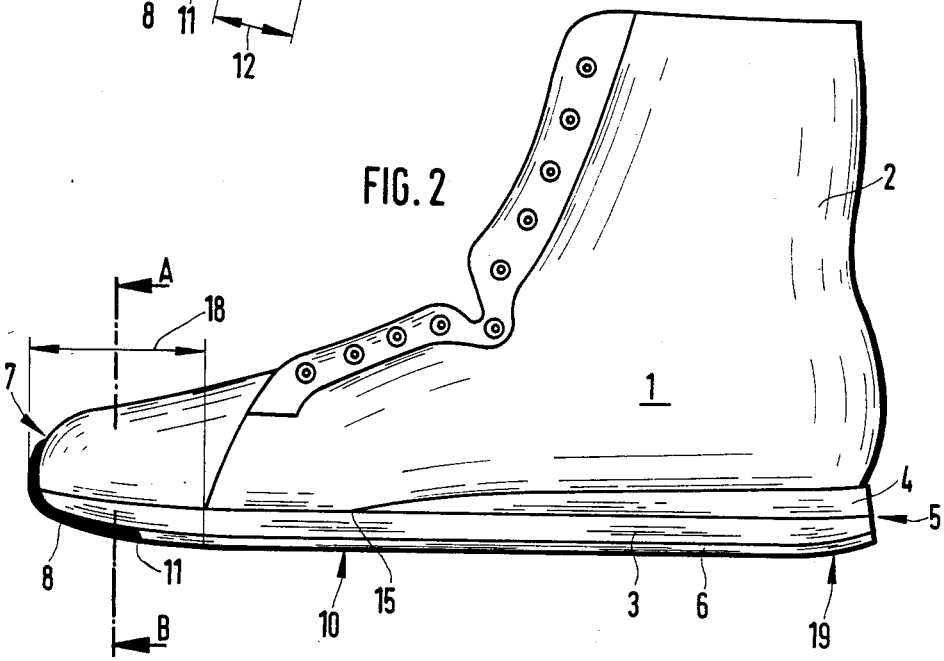
FIG. 2 is a side elevational view of an entire shoe in accordance with a preferred embodiment of the invention.
Figure 3:
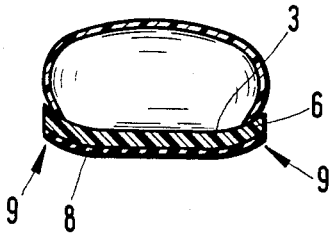
FIG. 3 is a lateral sectional view taken along line A-B of FIG. 2.

Designated as 1 is a shoe for rehabilitation purposes, particularly in the form of a boot with a relatively high upper 2 whose sole is comprised of an outsole 6 and a wedge-like midsole 5 that is formed of a midsole layer 3 having good cushioning properties and a harder wedge 4 overlying it.

Outsole 6 has a front part 8, extending from shoe tip 7 to the toe base joint, that is made of flexible, unprofiled (i.e., flat) material having a low coefficient of friction, at least with regard to conventional walking surfaces, like floors consisting of synthetic materials, carpeted areas, or ground surfaces like asphalt, cement, and the like. Suitable materials for front part 8 would include suede leather, like chrome suede leather, or suede split leather, or a low-friction flexible synthetic material having a napped or coarse outer surface which particularly simulates the surface of suede leathers, but which otherwise, however, is unprofiled.

A portion of front part 8 is drawn upwardly extending over the shoe tip to act as a shoe front protector. Advantageously, front part 8, in the area of edge 9 of outsole 6 and midsole layer 3, also has been drawn upwardly in order to cover these sole portions partially or entirely.

Next to front part 8, outsole 6 consists of a profiled outsole portion 10. This profiled outsole part 10 advantageously consists of a material having a high coefficient of friction, for example, a suitable rubber or synthetic material blend with known tread profiling.

The separating line 11 between the unprofiled front part 8 and the profiled outsole portion 10 extends diagonally in conformance with the toe base joint starting from the medial side, which is further in front, to the lateral side of outsole 6, which is further to the rear. This ensures that good ground engagement is produced in ball area 12, regardless of whether the foot strikes the ball area in the vicinity of the large toe or the small toe.

The continuous midsole layer 3 consists of elastic material with high cushioning properties, preferably polyurethane foam, or the like, having a Shore hardness of 30 to 40 Shore A, and more specifically, of 35 Shore A. On the other hand, the harder wedge 4 is made of a less cushioning material, but preferably, also a foam material, having a Shore A hardness of 60 to 70, and more specifically of 65 Shore A. To permit good flexture of the shoe sole in ball area 12, wedge 4 extends from the heel, maximally to the area of the midfoot, i.e., approximately up to ball area 12, which is indicated by the dash-dotted line 13 or by the dash line 14. Lines 13 or 14 thus correspond to the front edge 15 of wedge 4. Wedge 4 has a uniform thickness of 6 to 12 mm, to approximately the first third of the midfoot area, for example, and more specifically of 10 mm, and subsequently steadly slopes down to front edge 15.

Wedge 4 is longer at the medial side of the sole than at the lateral side of the sole, so that edge 15 conforms approximately to the slope of separating line 11, i.e., to the structure of the toe base joints, or that of the toe ball area, respectively.

Advantageously, in the area of the heel bone, wedge 4 may have a depression or recess 16, which is filled with a highly cushioning material, specifically of a Shore A hardness of 30 to 50. This recess 16 is indicated in FIG. 1 by a dotted line. It can also be advantageous to recess wedge 4 interiorly in such a way that it assumes the shape of recess 16', indicated by the cruciform (+++) line 17 in FIG. 1, which, for example, is approximately U-shaped.

Advantageously, the front section 18 of midsole layer 3 and outsole 6, starting approximately from the toe base joint area or from the ball region 12, is sloped or slightly curved upwardly, and the front of midsole layer 3, in this area 18, is tapered towards shoe tip 7. Such a design, additionally, reduces the danger of catching if there is unsteady ground contact by the foot.

Figure 4:
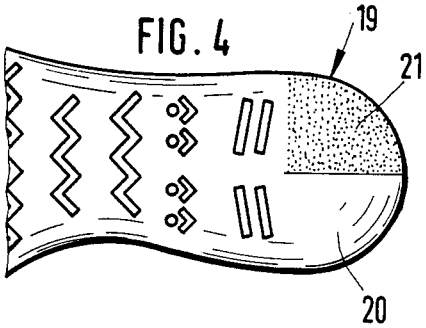
FIG. 4 is a partial bottom view of a modified shoe sole for a rehabilitation shoe, in accordance with the invention.

Moreover, the rear end section 19 of the shoe sole can be upwardly curved or angled towards the heel end of the sole. This is preferably facilitated by tapering of wedge 4 and/or the midsole layer 3. Advantageously, outsole 6 has a rear section 19 that is not profiled, or is only slightly profiled or roughened. Particularly, the ground engaging surface of the inner half 20 of the outsole 6 may be smooth, and the ground engaging surface of the outer half 21 of the sole may be slightly profiled or roughened, as can be seen from FIG. 4.

The continuous midsole layer 3 may have a thickness of 8 mm to 18 mm, and more specifically, of 13 mm. In contrast, wedge 4, in the section of approximately constant thickness, has a thickness of 6 to 12 mm, and more particularly of 10 mm.

The tapered section 18 of midsole layer 3, in edge area 9, may be upwardly slanted and/or curved, and front part 8 made of smooth material provides coverage thereof in edge portion 9.

The present invention provides a shoe for rehabilitation purposes which not only ensures a high degree of comfort and safety to the convalescent patient when walking, but more specifically also prevents unintentional shock impacts during the initial foot-ground contact which may have adverse effects on unhealed foot injuries.

While I have shown and described various embodiments in accordance with the present invention, it is understood that the same is not limited thereto, but is susceptible of numerous changes and modifications as known to those skilled in the art and I, therefore, do not wish to be limited to the details shown and described herein, but intend to cover all such changes and modifications as are encompassed by the scope of the appended claims.

I claim:

1. Shoe for rehabilitation purposes, particularly for wear in connection with injury and post-surgical foot rehabilitation, comprising an outsole having a front part that upwardly embraces the tip of the shoe, extends from the shoe tip to approximately a toe base joint location and is formed of an unprofiled material having a low coefficient of friction, at least with regard to conventional street, path and floor surfaces, and an outsole portion extending rearwardly from the front part that has a profiled ground contacting surface and is formed of an abrasion-resistant flexible material, a separation line between the front part and the rearwardly extending outsole portion extending diagonally rearwardly in conformance with the toe base joint from in front of a big toe ball area at a medial side of the shoe to a small toe area at the lateral side of the shoe; and a wedge-like midsole formed of a continuous midsole layer, primarily of constant thickness, and a wedge, extending over the midsole layer from the heel to a midfoot area, which wedge, viewed from above, terminates behind a big toe ball and small toe ball area, has a greater hardness than that of the midsole layer and is longer on the medial side of the shoe than on the lateral side thereof.

2. Shoe according to claim 1, wherein the wedge of the midsole has a hardness of 60 to 70 Shore A, and the continuous midsole sole layer has a hardness of 30 to 40 Shore A.

3. Shoe according to claim 2, wherein the wedge of the midsole has a constant thickness from the heel up to an initial region of the midfoot and subsequently extends diagonally downwardly towards the outsole in a wedge-shaped configuration.

4. Shoe according to claim 3, wherein the front part of the outsole consists of a suede leather.

5. Shoe according to claim 3, wherein the front part of the outsole consists of a flexible synthetic material.

6. Shoe according to claim 5, wherein an outer side of the front part has a finish which resembles the surface of suede leather.

7. Shoe according to claim 2, wherein the wedge of the midsole has a hardness of 65 Shore A and the continuous midsole layer has a hardness of 35 Shore A.

8. Shoe according to claim 2, wherein the wedge of the midsole has a depression or recess located in a heel bone area that is filled with material of between 30 and 50 Shore A hardness.

9. Shoe according to claim 1, wherein the wedge of the midsole has a depression or recess located in a heel bone area that is filled with a material of lesser hardness than that of the wedge.

10. Shoe according to claim 9, wherein the wedge of the midsole has a U-shape, with an open end of the U-shape pointing towards the tip of the shoe.

11. Shoe according to claim 9, wherein the wedge of the midsole has a constant thickness from the heel up to an initial region of the midfoot and subsequently extends diagonally downwardly towards the outsole in a wedge-shaped configuration.

12. Shoe according to claim 1, wherein the wedge of the midsole has a constant thickness from the heel up to an initial region of the midfoot and subsequently extends diagonally downwardly towards the outsole in a wedge-shaped configuration.

13. Shoe according to claim 12, wherein the midsole and the outsole taper forwardly in a section extending to the tip of the shoe from a slightly diagonally traversing location in an area between the toe base joint area and the ball area.

14. Shoe according to claim 13, wherein the tapering section of the midsole and the outsole slopes upwardly in an edge area and the front part of the outsole covers this edge area.

15. Shoe according to claim 1, wherein the front part of the outsole consists of a suede leather.

16. Shoe according to claim 1, wherein the front part of the outsole consists of a flexible synthetic material.

17. Shoe according to claim 6, wherein an outer side of the front part has a finish which resembles the surface of suede leather.

18. Shoe according to claim 1, wherein the midsole and the outsole taper forwardly in a section extending to the tip of the shoe from a slightly diagonally traversing location in an area between the toe base joint area and the ball area.

19. Shoe according to claim 18, wherein the tapering section of the midsole and the outsole slopes upwardly in an edge area and the front part of the outsole covers this edge area.

20. Shoe according to claim 19, wherein a ground engaging surface of a rear end section of the outsole slopes rearwardly upwardly.

21. Shoe according to claim 20, wherein said ground engaging surface is at most slightly profiled or roughened.

22. Shoe according to claim 21, wherein in the heel area, approximately an inner, medial, half of said ground engaging surface is substantially smooth and approximately the outer, lateral, half thereof is slightly profiled or roughened.

23. Shoe according to claim 1, wherein the front part of the outsole at least partially upwardly embraces the tip of the shoe.

24. Shoe according to claim 1, wherein a separation line between the front part and the rearwardly extending outsole portion extends at least approximately in a straight line between the big toe ball area and the small toe ball area.

* * * * *